US011414890B2

(12) United States Patent
Shih et al.

(10) Patent No.: US 11,414,890 B2
(45) Date of Patent: Aug. 16, 2022

(54) MAGNETIC LOCKING MECHANISM

(71) Applicant: Fulian Precision Electronics (Tianjin) Co., LTD., Tianjin (CN)

(72) Inventors: Tung-Ho Shih, New Taipei (TW); Yao-Chih Liu, New Taipei (TW)

(73) Assignee: Fulian Precision Electronics (Tianjin) Co., LTD., Tianjin (CN)

( * ) Notice: Subject to any disclaimer, the term of this patent is extended or adjusted under 35 U.S.C. 154(b) by 460 days.

(21) Appl. No.: 16/662,218

(22) Filed: Oct. 24, 2019

(65) Prior Publication Data

US 2021/0010295 A1 Jan. 14, 2021

(30) Foreign Application Priority Data

Jul. 10, 2019 (CN) ..... 201910621711.3

(51) Int. Cl.

| | |
|---|---|
| ***E05B 47/00*** | (2006.01) |
| ***H01F 7/02*** | (2006.01) |
| ***E05C 1/08*** | (2006.01) |
| ***E05B 65/00*** | (2006.01) |

(52) U.S. Cl.

CPC ..... *E05B 47/004* (2013.01); *E05B 47/0045* (2013.01); *E05C 1/08* (2013.01); *H01F 7/02* (2013.01); *E05B 65/006* (2013.01)

(58) Field of Classification Search

CPC .. E05B 47/004; E05B 47/0045; E05B 65/006; E05B 15/0073; E05C 1/08; E05C 17/56; E05C 19/16; H01F 7/02; Y10S 292/11; Y10T 292/11

USPC ..... 70/58, 163, 164, 166, 276, 413

See application file for complete search history.

(56) References Cited

U.S. PATENT DOCUMENTS

| | | | | |
|---|---|---|---|---|
| 5,485,733 | A * | 1/1996 | Hoffman | E05B 65/46 70/276 |
| 9,598,882 | B2 * | 3/2017 | Prat | E05B 73/0017 |
| 2008/0303675 | A1 * | 12/2008 | Hogan | E05B 73/0017 340/572.8 |
| 2012/0241522 | A1 * | 9/2012 | Yang | E05B 73/0052 235/492 |

FOREIGN PATENT DOCUMENTS

| | | |
|---|---|---|
| CN | 102655017 A | 9/2012 |
| CN | 207266413 U | 4/2018 |

* cited by examiner

*Primary Examiner* — Christine M Mills
*Assistant Examiner* — Yahya Sidky
(74) *Attorney, Agent, or Firm* — ScienBiziP, P.C.

(57) ABSTRACT

A magnetic locking mechanism includes a first housing, a second housing, and an unlocking member. The first housing includes a guiding member including a first through hole. The second housing includes a locking member including a telescopic rod. The unlocking member is configured to adsorb the locking member. When the locking member is moved along the guiding member to a preset position, the telescopic rod protrudes into the first through hole, and the second housing is locked to the first housing. When the unlocking member adsorbs the locking member protruded into the first through hole, the telescopic rod retracts from the first through hole, and the second housing is unlocked from the first housing.

12 Claims, 8 Drawing Sheets

MAGNETIC LOCKING MECHANISM

FIELD

The subject matter herein generally relates to locking mechanisms, and more particularly to a magnetic locking mechanism for locking and unlocking two housings.

BACKGROUND

Generally, a cover is fixed to a housing by screws. However, it may be inconvenient to assemble or remove the cover fixed to the housing by screws. Even though there are structures on the market for automatically locking a cover to a housing, the automatic locking structure may be easily unlocked, so that the automatic locking structure may not have an effective locking function.

BRIEF DESCRIPTION OF THE DRAWINGS

Implementations of the present disclosure will now be described, by way of embodiments, with reference to the attached FIGs.

DETAILED DESCRIPTION

Figure 1:
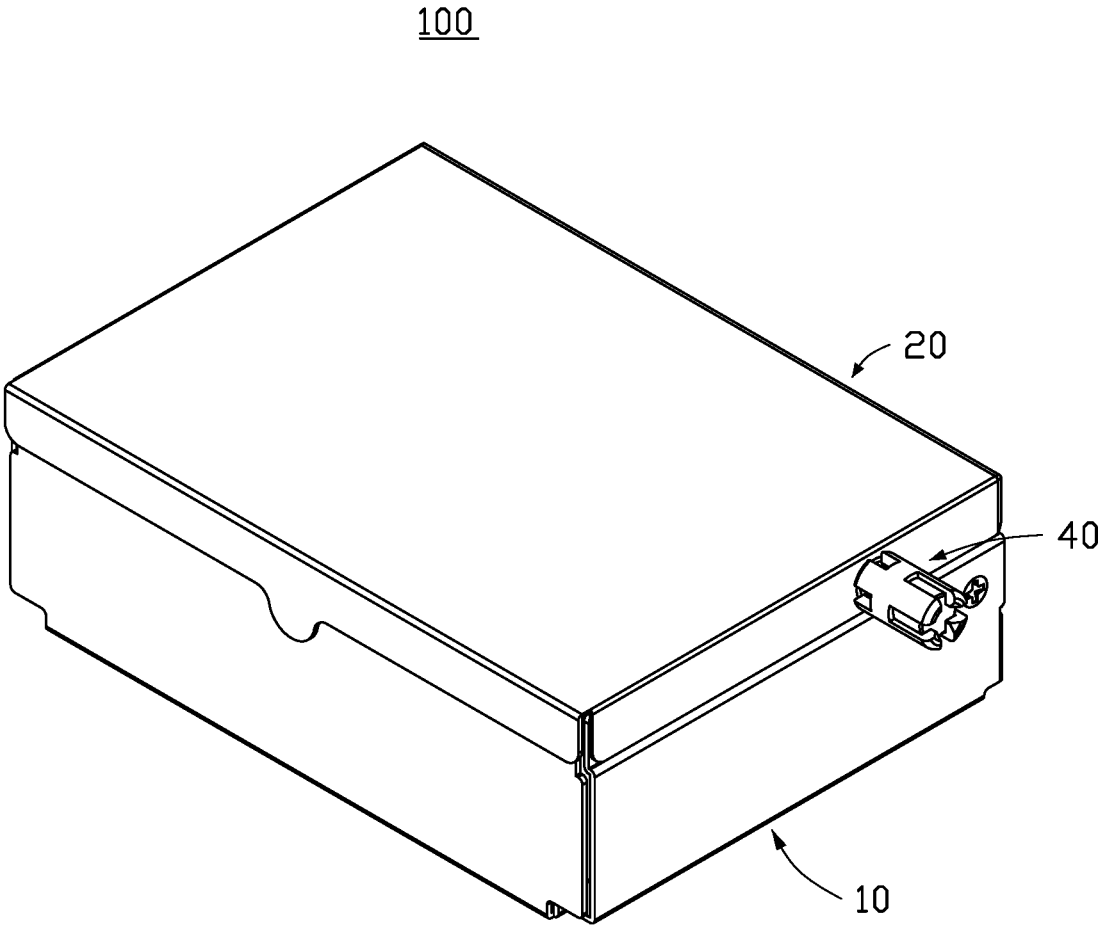
FIG. 1 is an assembled, isometric view of a first embodiment of a magnetic locking mechanism.

It will be appreciated that for simplicity and clarity of illustration, where appropriate, reference numerals have been repeated among the different FIGS. to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

First Embodiment

FIG. 1 shows an embodiment of a magnetic locking mechanism 100 for locking and unlocking two housings.

Figure 2:
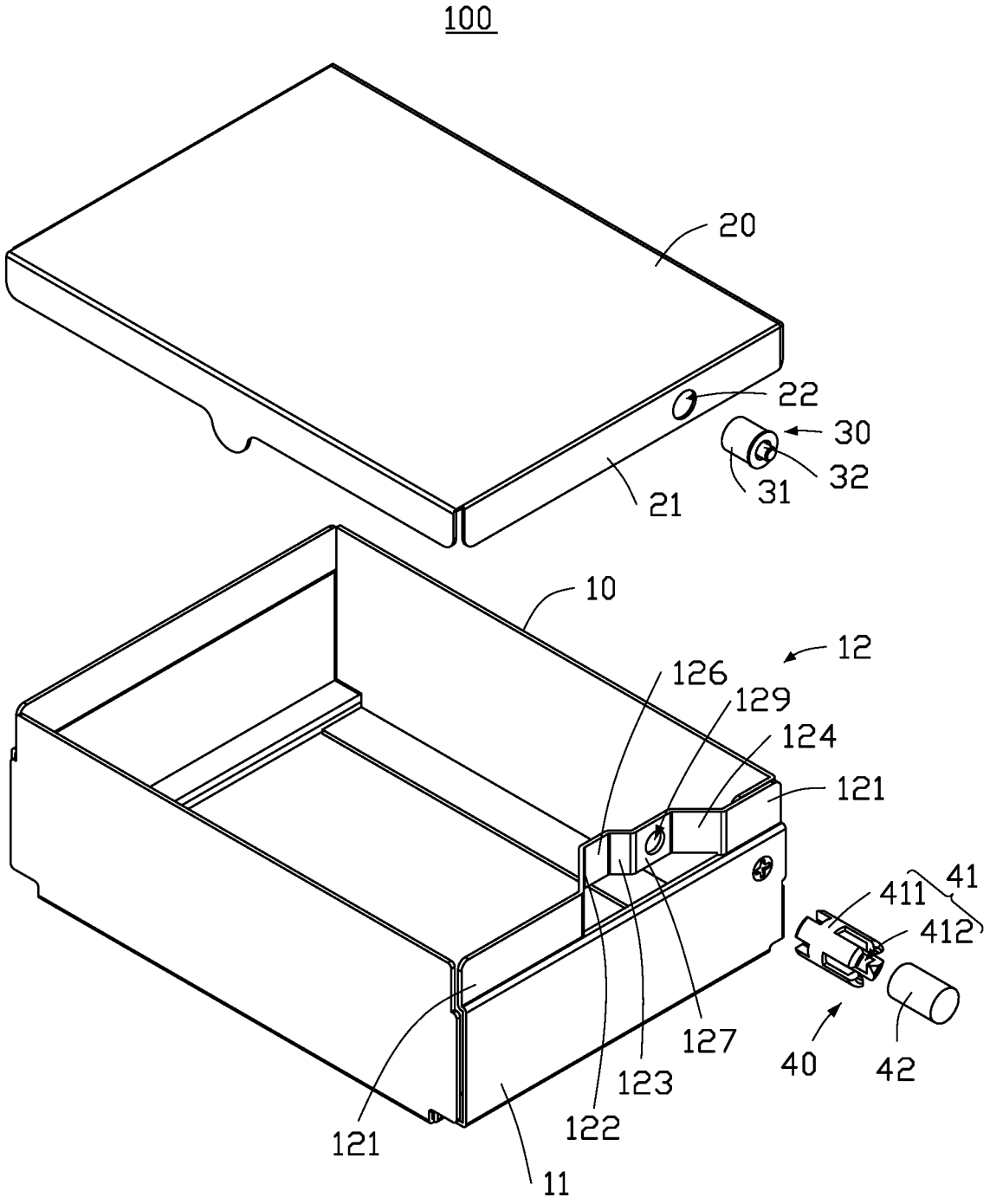
FIG. 2 is an exploded, isometric view of the magnetic locking mechanism in FIG. 1.

Referring to FIG. 1 and FIG. 2, the magnetic locking mechanism 100 includes a first housing 10 and a second housing 20, and the first housing 10 and the second housing 20 are provided with a locking structure. The locking structure includes a guiding member 12 arranged on the first housing 10 and a locking member 30 arranged on the second housing 20. The locking member 30 includes a telescopic rod 32. The guiding member 12 includes a first through hole 129. The magnetic locking mechanism 100 further includes an unlocking member 40 for adsorbing the locking member 30.

When the locking member 30 is moved to a predetermined position in a direction of the guiding member 12, the telescopic rod 32 protrudes into the first through hole 129, and the second housing 20 is locked to the first housing 10. When the unlocking member 40 adsorbs the locking member 20 protruded into the first through hole 129, the telescopic rod 32 is retracted from the first through hole 129, and the second housing 20 is unlocked from the first housing 10.

Referring to FIG. 2, the first housing 10 is substantially a hollow cuboid structure having an open side. The first housing 10 may be a chassis. A guiding member 12 is arranged at a first side wall 11 of the first housing 10. The guiding member 12 is adjacent to the open side of the first housing 10. It can be understood that the first housing 10 can adopt other shapes. The guiding member 12 is not limited to being arranged at the first side wall 11, but may also be arranged at other side walls.

Referring to FIG. 2, a length of the guiding member 12 is approximately the same as a length of the first side wall 11. The guiding member 12 includes a connecting portion 121. In one embodiment, two connecting portions 12 are respectively located on two ends of the guiding member 12, and the guiding member 12 is connected to the first side wall 11 by the connecting portions 121. The guiding member 12 further includes a first inclined portion 122, a second inclined portion 123, a third inclined portion 124, a first protruding portion 126, and a second protruding portion 127 between the two connecting portions 121. Specifically, the first inclined portion 122 and the second inclined portion 123 are respectively connected to two ends of the first protruding portion 126. The second inclined portion 123 and the third inclined portion 124 are respectively connected to two ends of the second protruding portion 127. The two connecting portions 121 are respectively connected to the first inclined portion 122 and the third inclined portion 124.

The first inclined portion 122, the second inclined portion 123, and the third inclined portion 124 are all inclined toward an inner side of the first housing 10. The first protruding portion 126 and the second protruding portion 127 protrude toward an inner side of the first housing 10 and are substantially parallel to the first side wall 11. In one embodiment, the first protruding portion 126 and the second protruding portion 127 are not in the same plane, and a distance between the first protruding portion 126 and the first sidewall 11 is greater than a distance between the second protruding portion 127 and the first side wall 11, such that the locking member 30 has sufficient space between the first side wall 11 and the guiding member 12 and continue to move along the guiding member 12. The first through hole 129 is defined in the second protruding portion 127 to cooperate with the locking member 30. It can be understood that, in other embodiments, the inclined portions and the protruding portions of the guiding member 12 may be replaced with other structures according to the structure of the locking member 30. For example, the first protruding portion 126 and the second protruding portion 127 can be in the same plane. At this time, a length of the locking member 30 should be increased, and a position of the first through hole 129 can be adjusted accordingly. The guiding member 12 may be integrally formed with the first housing 10.

Referring to FIG. 2, the second housing 20 has a substantially cuboid structure and is located at the open side of the first housing 10. Further, the second housing 20 is an upper cover corresponding to the first housing 10. The second housing 20 is provided with a bent portion 21 at a position corresponding to the first side wall 11, and the bent portion 21 is bent in a direction of the first housing 10. The bent portion 21 is provided with a fixing hole 22 corresponding to the first through hole 129, and the locking member 30 is arranged at a position of the fixing hole 22. When the second housing 20 is covered on the first housing 10, the bent portion 21 is stacked with the guiding member 12, and the guiding member 12 is located on an inner side of the bent portion 21.

Figure 3:
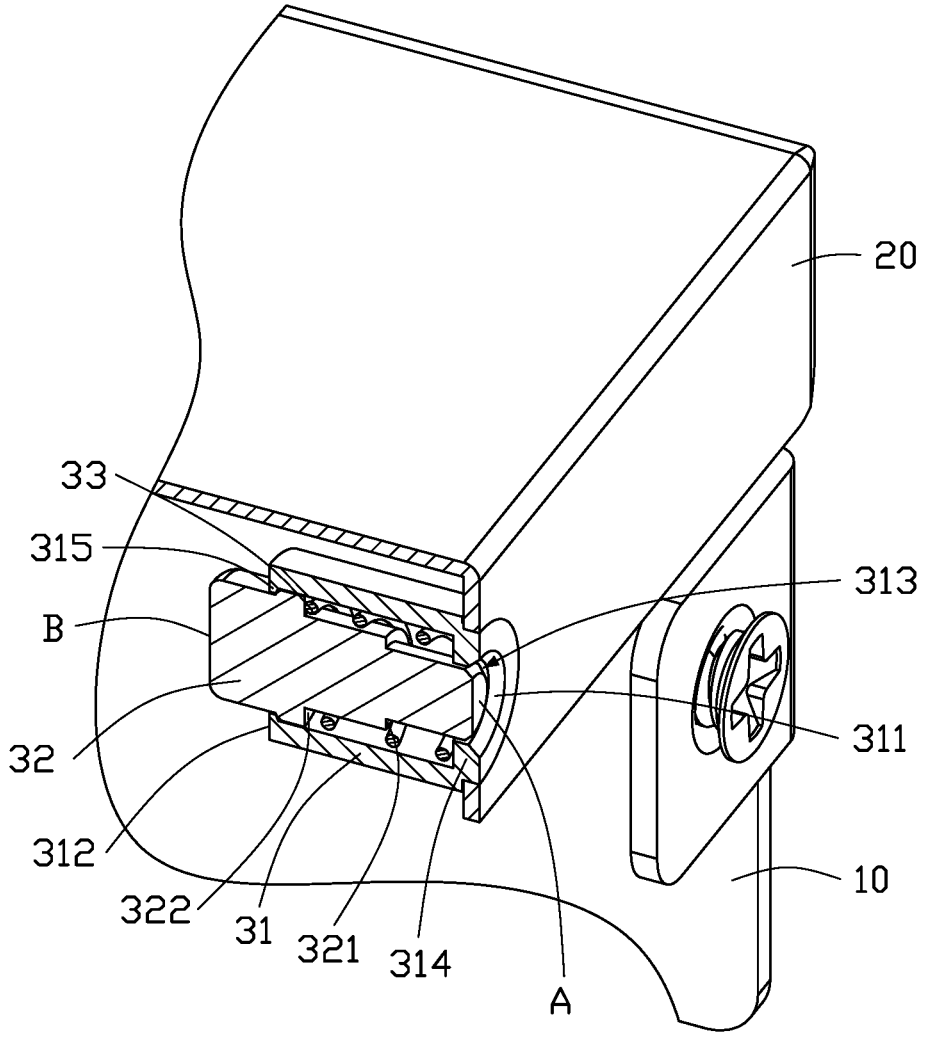
FIG. 3 is a cutaway view of a locking member.

Referring to FIG. 3, the locking member 30 is used to lock the second housing 20 to the first housing 10. The locking member 30 includes a fixing portion 31, a telescopic rod 32, and a resilient member 33. The fixing portion 31 is arranged on the second housing 20 and located on an inner side of the second housing 20, and the fixing portion 31 is positioned at a position of the fixing hole 22. The resilient member 33 is received in the fixing portion 31, the telescopic rod 32 is partially received in the fixing portion 31, and the resilient member 33 is sleeved on the telescopic rod 32, such that the telescopic rod 32 can move within the fixing portion 31.

The fixing portion 31 is substantially cylindrical and includes a second through hole 313 extending from a third end 311 to an opposite fourth end 312. In one embodiment, the third end 311 is provided with a groove (not shown). The groove latches the bent portion 21. The third end 311 is further provided with a first abutting portion 314 located on an inner side of the third end 311. The first abutting portion 314 is configured to abut the telescopic rod 32 and the resilient member 33. A second abutting portion 315 is located on an inner side of the fourth end 312, and the second abutting portion 315 is configured to abut the telescopic rod 32. Further, a length of the first abutting portion 314 extending along a center line of the fixing portion 31 is greater than a length of the second abutting portion 315.

The telescopic rod 32 includes a first end A and a second end B opposite to the first end A. The diameter of the telescopic rod 32 increases from the first end A to the second end B to match the first abutting portion 314 and the second abutting portion 315. The first end A is correspondingly located at the third end 311 and can protrude from the third end 311. The second end B is correspondingly located at the fourth end 312 and can protrude from the fourth end 312. The telescopic rod 32 includes a third abutting portion 321 located about ⅓ from the first end A to the second end B, and includes a fourth abutting portion 322 located about ⅔ from the first end A to the second end B. The third abutting portion 321 is configured to abut the first abutting portion 314, and the fourth abutting portion 322 is configured to abut the second abutting portion 315 and the resilient member 33.

The two ends of the resilient member 33 respectively abut the first abutting portion 314 and the fourth abutting portion 322, and a resilient force of the resilient member 33 drives the telescopic rod 32 to move within the fixing portion 31. The resilient member 33 may be a spring. It can be understood that the resilient member 33 can also be replaced with other structures having a similar effect or function. In order to avoid offsetting the resilient member 33 in the fixing portion 31, two ends of the resilient member 33 can be respectively embedded on the fixing portion 31 and the telescopic rod 32, so that the fixing portion 31 and the telescopic rod 32 are not easily detached.

Referring to FIG. 2, the unlocking member 40 is configured to adsorb the telescopic rod 32 such that the telescopic rod 32 can protrude out of the fixing hole 22 to unlock the second housing 20 from the first housing 10. The unlocking member 40 includes a buckle 41 and a magnetic member 42. The buckle 41 includes a plurality of latches 411. The plurality of latches 411 define a receiving cavity 412. The magnetic member 42 is received in the receiving cavity 412 and is fixed by the latches 411. Further, the magnetic member 42 is a magnet. In one embodiment, the buckle 41 includes four latches 411. It can be understood that in other embodiments, the number of the latches 411 can be three, five, or other number. The unlocking member 40 can also be replaced with other members that can adsorb the telescoping rod 32, such as a magnetic T-shaped structure.

Figure 4:
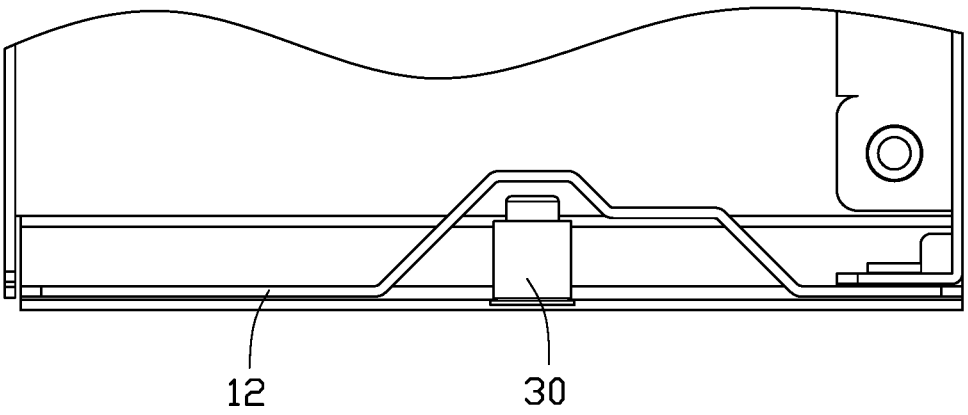
FIG. 4 is a cross-sectional view showing the locking member moved to a first protruding portion.
Figure 5:
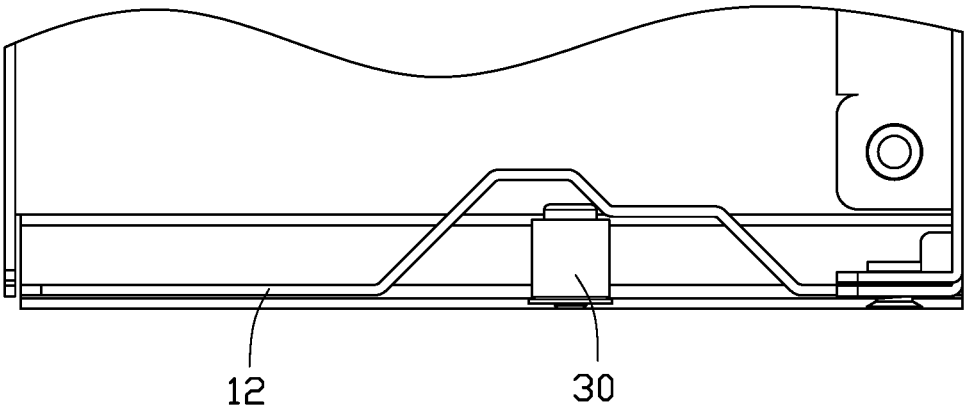
FIG. 5 is a cross-sectional view showing the locking member abutting on an inclined portion.
Figure 6:
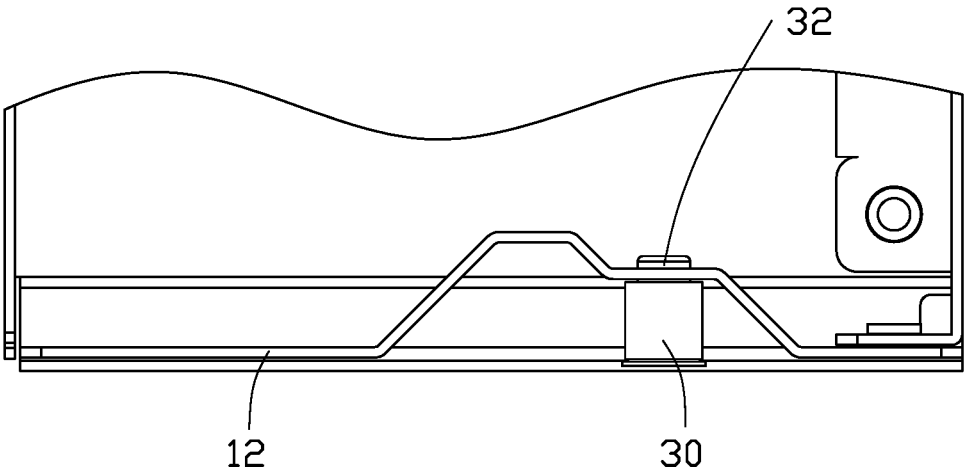
FIG. 6 is a cross-sectional view showing the locking member moved to a position of a first through hole.

Referring to FIG. 4, FIG. 5, FIG. 6, and FIG. 7, when the second housing 20 is to be locked on the first housing 10, the bent portion 21 including the locking member 30 is moved along the direction of the guiding member 12, such that the locking member 30 is positioned between the first protruding portion 126 and the first side wall 11. At this time, the second end B of the telescopic rod 32 protrudes out from the fourth end 312, as shown in FIG. 4. Then, continuing to move toward the second protruding portion 127, the telescopic rod 32 abuts the second inclined portion 123, the telescopic rod 32 is moved toward the third end 311, the resilient member 33 is compressed, the telescopic rod 32 continues to move onto the second protruding portion 127 and protrudes into the first through hole 129, and the second end B protrudes out of the fixing portion 31, the first end A is received in the fixing portion 31, and the fourth abutting portion 322 abuts the second abutting portion 315. At this time, the locking member 30 locks the second housing 20 on the first housing 10 and the locking member 30 is completely received inside the second housing 20, as shown in FIG. 5 and FIG. 6.

Figure 7:
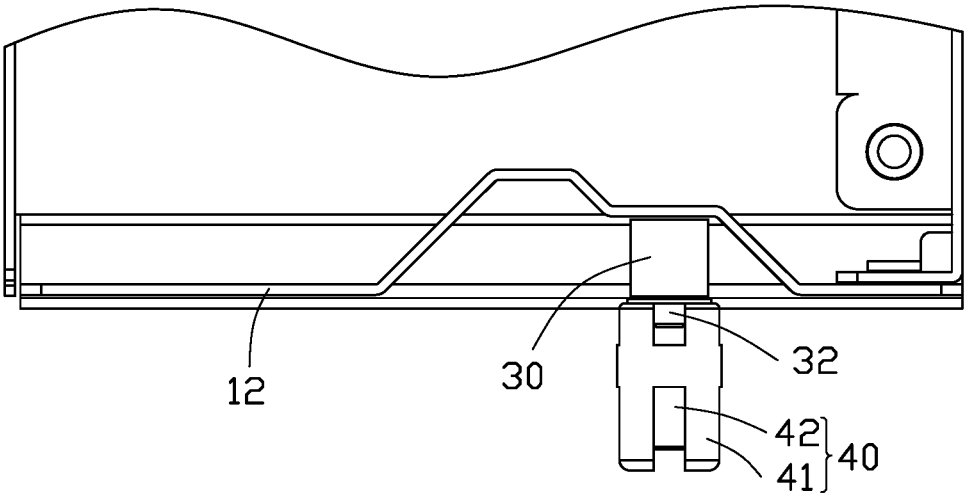
FIG. 7 is a cross-sectional view showing an unlocking member adsorbing the locking member.

When the second housing 20 is to be unlocked from the first housing 10, the unlocking member 40 is aligned with the locking member 30, and the magnetic member 42 adsorbs the telescopic rod 32. The telescopic rod 32 moves toward the third end 311, the first end A protrudes out of the third end 311, and the second end B is received in the fixing portion 31, the third abutting portion 321 abuts the first abutting portion 314, and the resilient member 33 is compressed. At this time, the second housing 20 can be unlocked from the first housing 10 as shown in FIG. 7. It can be understood that when the unlocking member 40 is removed from the locking member 30, the telescopic rod 32 is retracted into the second casing 20 due to the resilient force of the resilient member 33.

Second Embodiment

Figure 8:
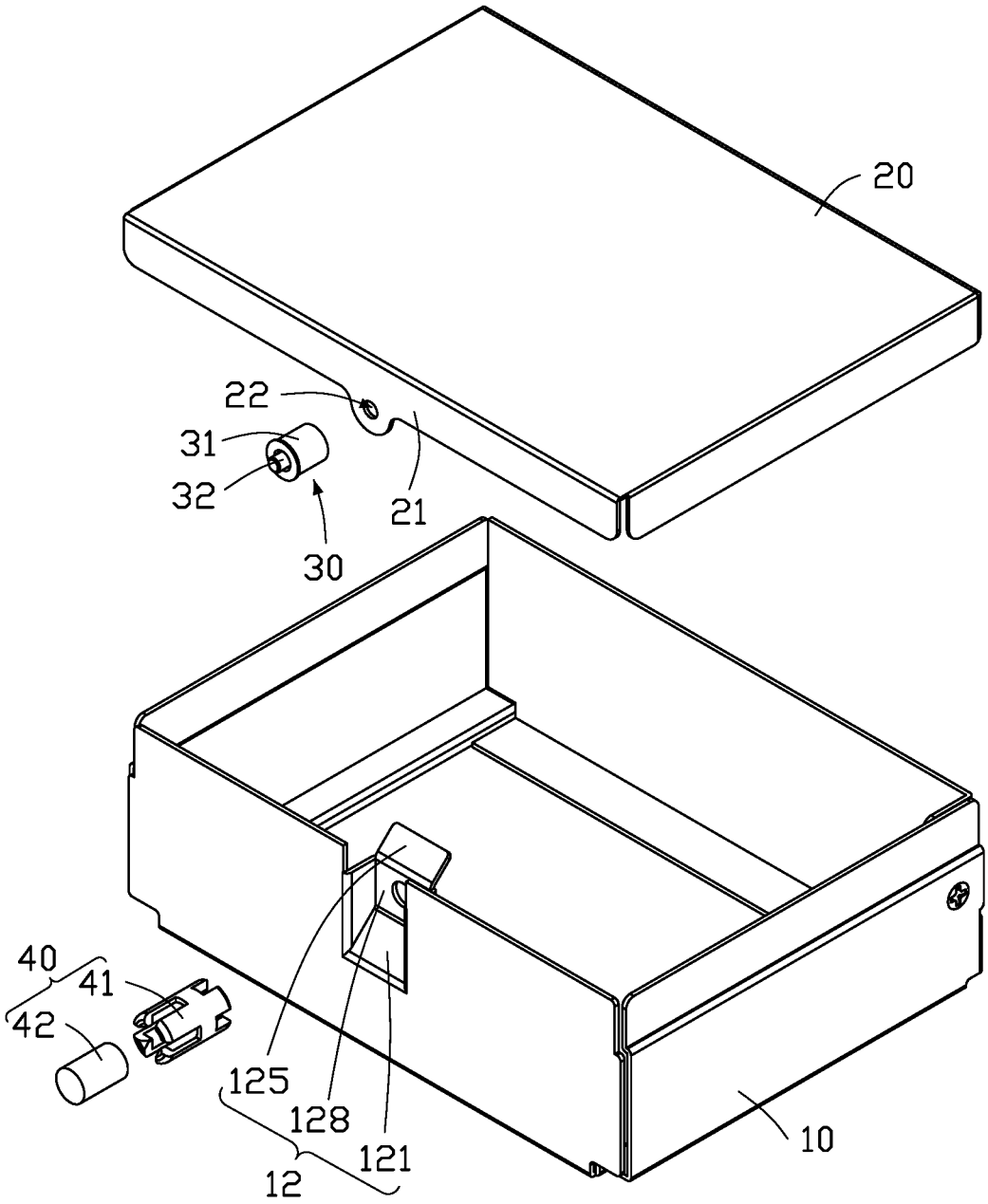
FIG. 8 is an exploded, isometric view of a second embodiment of a magnetic locking mechanism.

Referring to FIG. 8, the second embodiment is substantially similar to the first embodiment, but the second embodiment differs from the first embodiment in that the guiding member 12 in the second embodiment includes a connecting portion 121, a third protruding portion 128, and a fourth inclined portion 125. One end of the connecting portion 121 is connected to the side wall of the first housing 10 and inclined toward the inner side of the first housing 10. One end of the third protruding portion 128 is connected to the connecting portion 121 and substantially parallel to the sidewall of the first housing 10, so that the third protruding portion 128 also protrudes toward the inner side of the first housing 10. The other end of the third protruding portion 128 is connected to one end of the fourth inclined portion 125, and the other end of the fourth inclined portion 125 is further biased toward the inner side of the first housing 10 for guiding movement of the locking member 30. The first through hole 129 is located on the third protruding portion 128.

The actuation process of the second embodiment is substantially the same as the actuation process of the first embodiment, and will not be further described herein.

In summary, the magnetic locking mechanism 100 provides a locking structure on the first housing 10 and the second housing 20, that is, the locking member 30 arranged on the second housing 20 inserts through the first through hole 129 of the guiding member 12 to lock the two housing together. The unlocking member 40 adheres the locking member 30 to cause the locking member 30 to remove from the first through hole 129 to unlock the two housings. The magnetic locking mechanism 100 has a simple structure, and the two housings are not required to be locked or unlocked by screws. It can be understood that the magnetic locking mechanism 100 can also be used on other structures that need to be locked.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A magnetic locking mechanism comprising:

a first housing comprising a guiding member, the guiding member comprising a first through hole;

a second housing comprising a locking member, the locking member comprising a rod; and an unlocking member, wherein:

the unlocking member is configured to magnetically attract the locking member;

when the locking member is moved along the guiding member to a preset position, the rod protrudes into the first through hole, and the second housing is locked to the first housing; and when the unlocking member magnetically attracts the locking member protruded into the first through hole, the rod retracts from the first through hole, and the second housing is unlocked from the first housing;

wherein the guiding member comprises a connecting portion, a first protruding portion, a second protruding portion, and an inclined portion; the inclined portion, the first protruding portion, and the second protruding portion are spaced apart; the connecting portion is coupled to the inclined portion; each of the first protruding portion and the second protruding portion protrudes toward an inner side of the first housing; and the first protruding portion and the second protruding portion are not in the same plane.

2. The magnetic locking mechanism of claim 1, wherein:

the locking member further comprises a fixing portion and a resilient member;

the fixing portion is arranged on the second housing;

the resilient member is received in the fixing portion;

the rod is partially received in the fixing portion; and the resilient member is arranged on the rod.

3. The magnetic locking mechanism of claim 2, wherein:

the rod comprises a first end and a second end opposite the first end; and a diameter of the rod increases from the first end to the second end.

4. The magnetic locking mechanism of claim 3, wherein:

the fixing portion comprises a second through hole extending from a third end to a fourth end of the fixing portion;

the third end comprises a first abutting portion, and the fourth end comprises a second abutting portion; and the rod comprises a third abutting portion and a fourth abutting portion respectively corresponding to the first abutting portion and the second abutting portion of the fixing portion.

5. The magnetic locking mechanism of claim 4, wherein:

one end of the resilient member abuts the first abutting portion; and another end of the resilient member abuts the fourth abutting portion.

6. The magnetic locking mechanism of claim 1 wherein:

the first through hole is located on the second protruding portion;

the second housing comprises a bent portion; and the locking member is arranged on the bent portion.

7. The magnetic locking mechanism of claim 6, wherein:

the guiding member comprises two connecting portions respectively located on two ends of the guiding member;

the guiding member is coupled to a side wall of the first housing by the two connecting portions;

the guiding member further comprises a first inclined portion, a second inclined portion, a third inclined portion, the first protruding portion, and the second protruding portion between the two connecting portions;

the first inclined portion and the second inclined portion are respectively coupled to two ends of the first protruding portion;

the second inclined portion and the third inclined portion are respectively coupled to two ends of the second protruding portion; and the two connecting portions are respectively coupled to the first inclined portion and the third inclined portion.

8. The magnetic locking mechanism of claim 5, wherein:

the unlocking member comprises a buckle and a magnetic member;

the magnetic member is arranged within the buckle; and the magnetic member is configured to magnetically attract the rod.

9. The magnetic locking mechanism of claim 8, wherein:

the buckle comprises a plurality of latches surrounding a receiving cavity;

the magnetic member is received within the receiving cavity.

10. The magnetic locking mechanism of claim 1, wherein:

the guiding member is integrally formed with a sidewall of the first housing.

11. The magnetic locking mechanism of claim 2, wherein:

two ends of the resilient member are respectively embedded on the fixing portion and the rod.

12. A magnetic locking mechanism comprising:

a first housing comprising a guiding member, the guiding member comprising a first through hole;

a second housing comprising a locking member, the locking member comprising a rod; and an unlocking member, wherein:

the unlocking member is configured to magnetically attract the locking member;

when the locking member is moved along the guiding member to a preset position, the rod protrudes into the first through hole, and the second housing is locked to the first housing; and when the unlocking member magnetically attracts the locking member protruded into the first through hole, the rod retracts from the first through hole, and the second housing is unlocked from the first housing;

wherein the guiding member comprises a connecting portion, an inclined portion, and a third protruding portion; two ends of the third protruding portion are respectively coupled to the connecting portion and the inclined portion; the third protruding portion protrudes toward an inner side of the first housing; and the first through hole is located on the third protruding portion.

* * * * *